United States Patent [19]

Willingham

[11] 4,295,320

[45] Oct. 20, 1981

[54] CLOSURE CONVERSION APPARATUS FOR EXISTING CLOSURE APPLICATING MACHINES

[75] Inventor: Wendell D. Willingham, Toledo, Ohio

[73] Assignee: Owens-Illinois, Inc., Toledo, Ohio

[21] Appl. No.: 94,514

[22] Filed: Jan. 9, 1980

[51] Int. Cl.[3] ..... B67B 3/20; B65B 7/28

[52] U.S. Cl. ..... 53/201; 53/331.5; 53/362

[58] Field of Search ..... 53/201, 331.5, 317, 53/362

[56] References Cited

U.S. PATENT DOCUMENTS

| | | | |
|---|---|---|---|
| 2,076,631 | 4/1937 | Gantzer | 53/331.5 |
| 2,359,932 | 10/1944 | Newey | 53/201 |
| 2,819,577 | 1/1958 | Dimond | 53/317 |
| 3,134,211 | 5/1964 | Roberts et al. | 53/331.5 |
| 3,470,667 | 10/1969 | David et al. | 53/201 X |
| 3,524,294 | 8/1970 | Koll | 53/201 X |
| 3,537,231 | 11/1970 | Dimond | 53/201 |
| 3,771,284 | 11/1973 | Boeckmann et al. | 53/331.5 X |
| 4,089,153 | 5/1978 | Long | 53/331.5 |
| 4,099,361 | 7/1978 | Dix et al. | 53/201 X |
| 4,173,104 | 11/1979 | Koll | 53/201 |
| 4,222,215 | 9/1980 | Takano | 53/331.5 |

*Primary Examiner*—Horace M. Culver

*Attorney, Agent, or Firm*—John R. Nelson; Myron E. Click; David H. Wilson

[57] ABSTRACT

This invention provides substitute capping heads to apply a threaded closure on a bottle neck through the utilization of existing machines which were designed to apply an aluminum closure on a bottle neck by in situ formation of the threads in an aluminum shell. The modified capping heads embodying this invention utilize the same rotational and vertical movements of the capping heads relative to the containers, but effect a frictional engagement with a pre-formed, internally threaded plastic closure to effect the screwing of such closure onto a bottle neck with the effective application torque being limited by a slip clutch incorporated in the drive train of the modified capping head. Such clutch is isolated from ambient humidity conditions, and in some modifications operates in an oil bath.

5 Claims, 11 Drawing Figures

CLOSURE CONVERSION APPARATUS FOR EXISTING CLOSURE APPLICATING MACHINES

BACKGROUND OF THE INVENTION

Innovation in the carbonated beverage bottling industry is very much dependent on the ready availability of machinery for processing new types of containers and/or closures. For years, the crown was the dominant closure employed and only in the last fifteen years was there any significant swing to a different type of closure, which comprised a cap shell of aluminum which was inserted over the threaded neck end of the container and then secured in place by rolling threads in situ into the walls of the cap shell. Such closures are commonly called roll-on caps. This type of closure application necessarily required a completely new applicating machine because not only was an axial force necessary to hold the closure in place on the bottle neck and to form a seal between the closure liner and the end of the bottle neck, but concurrently, a rotating movement had to be imparted to the thread forming rollers. There was no way that a conventional crown-type applicating machine could be modified to apply the new style roll-on closures and, as a result, the adoption of the new closure proceeded very slowly.

However, it did proceed and practically every carbonated beverage bottler now has a machine installed in his bottling line that is capable of applying an aluminum shell on the neck of a bottle and rolling threads into the shell to effect the threaded securement of the roll-on closure to the bottle.

In recent years, there have been significant developments in plastic technology making the utilization of a threaded plastic closure completely feasible for use in the carbonated beverage field. For example, a threaded closure of the type shown in U.S. Pat. Nos. 3,987,921 and 4,016,996 has been shown to be commercially practicable, and would be an economically desirable change for the average bottler to adopt, if he did not have to invest in new applicating machinery to assemble this style closure to the bottle neck.

Since this particular closure requires a concurrent application of an axial force to the top panel of the closure with a rotation of the closure relative to the bottle neck, it would obviously be desirable to attempt to utilize the existing closure applicating machines for effecting the assemblage of aluminum shells to bottle necks to apply this new style plastic closure, and thus greatly minimize the capital investment required for the average bottler to adopt the new plastic closure.

There is, therefore, a distinct need for an inexpensive capping head which may be applied to existing roll-on closure applicating machines for effecting the assemblage of plastic screw thread type closures to bottle necks.

Any such new capping head must also incorporate mechanism for limiting the maximum torque applied to the closure. Since the closure is fabricated from a thermoplastic material, it is subject to tearing and/or cracking if an excessive applicating force is applied. Moreover, it is necessary that the maximum applicating torque be maintained substantially constant, irrespective of the ambient conditions, and particularly independent of the ambient humidity conditions, which vary widely in a bottling plant, particularly in the morning start up period of the plant.

SUMMARY OF THE INVENTION

This invention provides an improved capping head which may be readily assembled on existing cap applicating machines for roll-on type closures to effect the application of an internally screw threaded plastic closure to the threaded neck of a bottle. The invention provides an annular housing which is secured to one of the customary hollow vertical capping head shafts provided on conventional roll-on capping machines and is both rotated and axially shifted by such vertical shaft. An annular assemblage including a cap actuator is mounted for rotation on the annular housing but is connected to the annular housing for co-rotation solely by an annular slip-clutch friction washer which is disposed between a radial surface on the housing and a radial surface on the applicator assembly. The washer is disposed in a chamber which is essentially isolated from ambient humidity.

Other objects and advantages of the invention will be readily apparent to those skilled in the art from the following detailed description, taken in conjunction with the annexed sheets of drawings.

DESCRIPTION OF PREFERRED EMBODIMENTS

Figure 1:
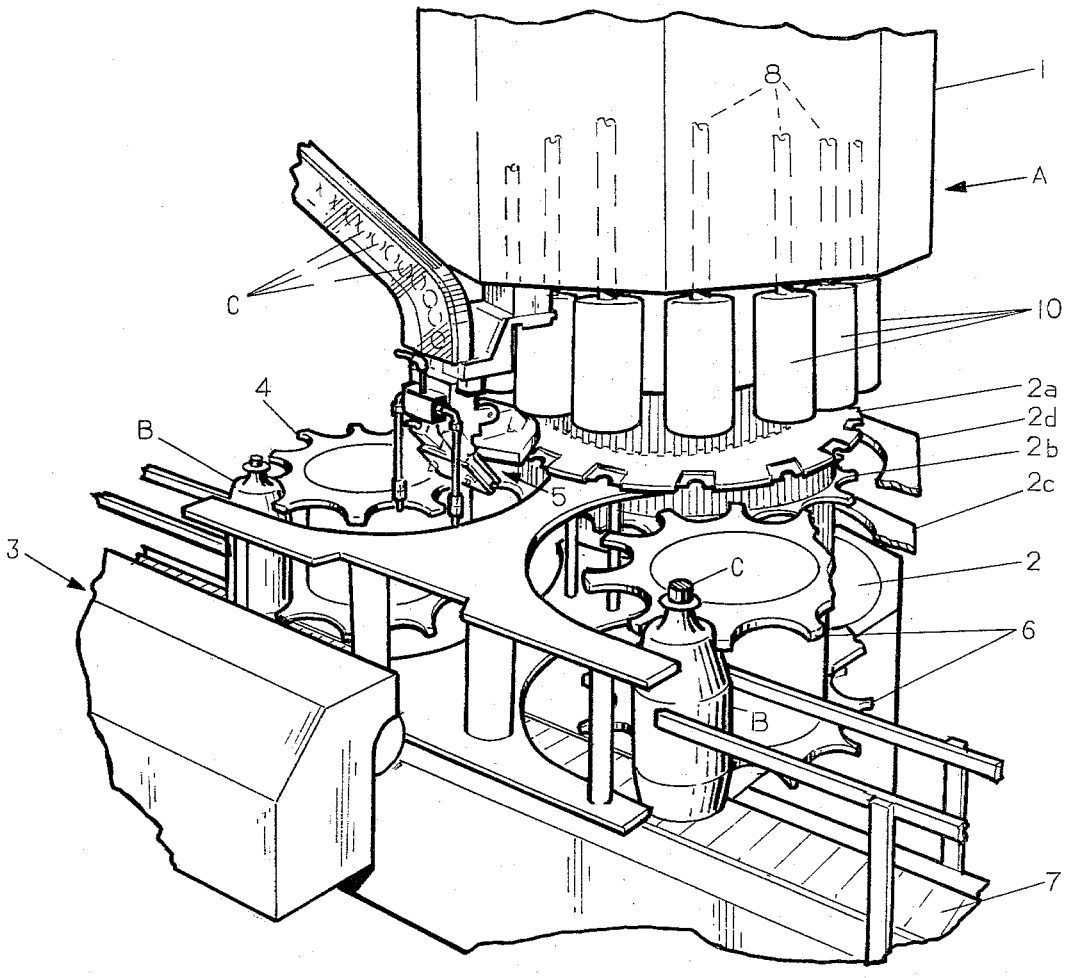
FIG. 1 is a schematic perspective view of a complete cap applicating machine incorporating capping heads embodying this invention.
Figure 2:
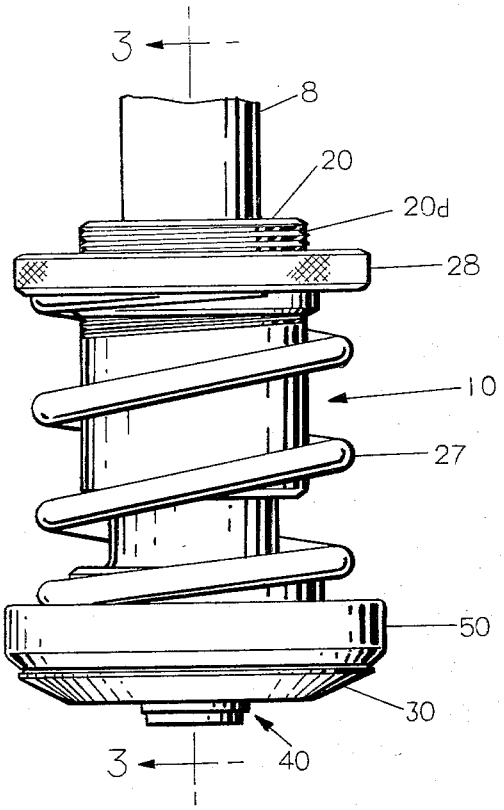
FIG. 2 is a side elevational view of a capping head embodying this invention.
Figure 5:
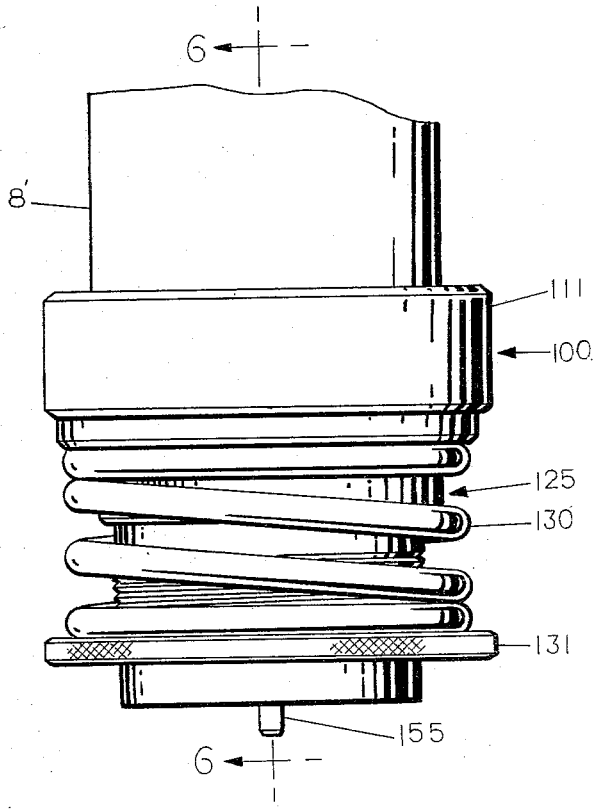
FIG. 5 is a side elevational view of a modified capping head embodying this invention.
Figure 3:
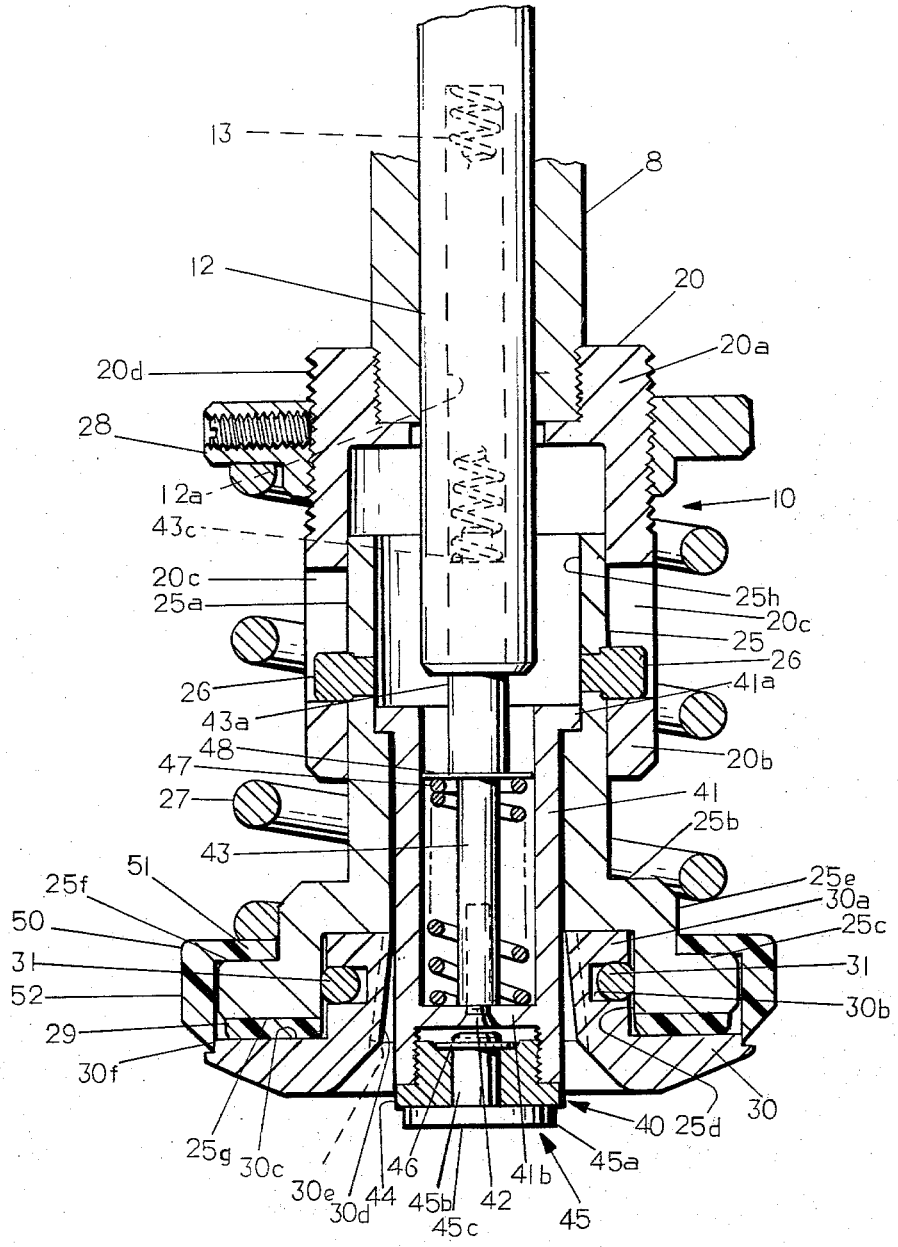
FIG. 3 is a sectional view taken along the plane 3—3 of FIG. 2, showing the components of the capping head in their positions occupied prior to engagement with a cap to be applied to a bottle.

Referring to FIGS. 1-3, a plurality of capping heads 10 embodying this invention are designed for application to a capping machine A of the type heretofore manufactured and sold by Aluminum Company of America for the application of roll-on closures to the threaded necks of beverage bottles. A machine of this type is described and illustrated in detail in U.S. Pat. No. 3,760,561 to David J. Over et al, hence the mechanism of the entire capping machine A will not be further described. The machine does involve a rotating turret 1 moving with rotating bottle table 2. Star wheels 2a and 2b located above table 2 also rotate with table 2 and provide lateral support to the side wall and neck portions of the bottles as they are moved in a circular path by the rotary bottle table 2. Guide rails 2c and 2d hold the bottles in the star wheel pockets.

The bottles B, filled with carbonated beverage or any other liquid product, are supplied to the rotary table 2 by a conventional worm infeed 3 and a star wheel transfer 4. Immediately before entering the rotary table 2, an internally threaded plastic cap C is loosely deposited on the neck of each bottle by a conventional cap feeding mechanism 5. The caps C are successively engaged by the rotating applicating heads 10 and applied to the threaded neck of the bottles B as the bottles are moved around the periphery of the rotary table 2. The capped bottles are removed from the rotary bottle table 2 by a conventional star wheel 6 and deposited on a moving conveyor 7 which conveys them to a case packer (not shown).

As is described in detail in the aforementioned U.S. Pat. No. 3,760,561, the rotating turret 1 of capping machine A provides a mounting for a plurality of vertically disposed hollow shafts 8 on the bottom end of which the capping heads 10 embodying this invention are respectively applied. Hollow shafts 8 are continuously rotated and, as the shafts 8 are moved in their rotary path by the rotating turret 1, they are successively vertically displaced toward the rotary bottle table 2 to bring the capping heads 10 respectively into firm engagement with the top portions of a cap C which is respectively positioned on the neck of a bottle B beneath each capping head 10. Conventional means (not shown) are provided to restrain bottles B from rotation. Capping head 10 exerts a combined axial thrust and rotational force upon each cap C to effect the threading of the cap C onto the threaded neck of bottle B with a preselected degree of torque, following which the capping head 10 is raised relative to the bottle and the capped bottle is thus freed for discharge into the bottle removal star wheel 6.

Figure 4:
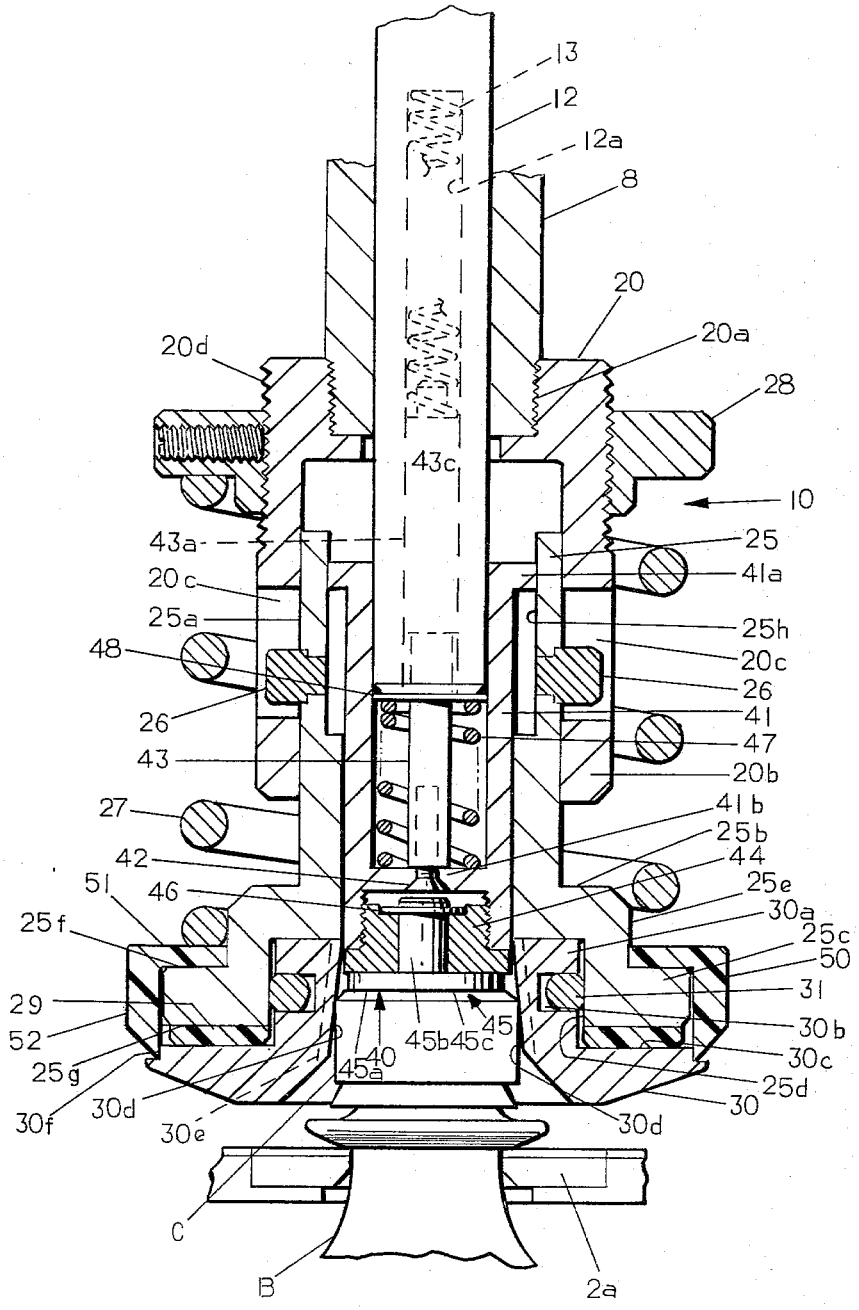
FIG. 4 is a view similar to FIG. 3 but showing the position of the components of the capping head after complete engagement of the cap with the threaded bottle neck has been achieved.

Referring now to FIGS. 2, 3 and 4, the details of one embodiment of a capping head constructed in accordance with this invention will now be described. The capping head 10 comprises a primary annular housing 20 having an internally threaded upper end portion 20a by which it is secured to threads provided on the bottom end of hollow rotating shaft 8. Primary housing 20 has a downwardly extending annular portion 20b and this portion is provided with diametrically opposed axially extending slots 20c.

A secondary annular housing 25 is provided having a sleeve-like body portion 25a slidably journalled in the annular portion 20b of primary housing 20. A pair of diametrically opposed pins 26 are threadably mounted in the side walls of secondary housing portion 25a and slidably co-operate with the axially extending slots 20c in the primary housing 20 to insure that the secondary housing is co-rotatable with primary housing 20 but is axially shiftable relative thereto.

The lower portion of secondary housing 25 is provided with a first radially outwardly directed flange 25b which in turn is connected by an axial extension 25e to a second, larger radial flange 25c. Flange 25b provides an enlarged cylindrical recess 25d in the bottom end of secondary housing 25 to mount an annular cap actuator 30. Cap actuator 30 is axially fixed relative to the secondary housing 25 but is freely rotatable with respect to such housing. An annular groove 30b is provided in the hub portion 30a of the annular cap actuator 30 and a pair of retaining pins 31 are passed through the wall of the lower flange portion 25c of secondary housing 25 and respectively engage the annular groove 30b to provide the axial locking of the actuator 30 relative to the secondary housing 25, without in any manner interfering with the freedom of relative rotation between such components. Secondary housing 25 and cap actuator 30 are hereinafter referred to as a cap actuator assembly.

The second radial flange 25c has a top surface 25f defining a support for a spring 27. The other end of spring 27 is retained by an adjusting collar 28 which is threadably mounted on exterior threads 20d provided on the primary housing 20. Thus, adjustment of the axial position of the threaded collar 28 relative to the primary housing 20 determines the degree of axial force imparted by spring 27 to the secondary housing 25.

The lower face of flange 25c of secondary housing 25 defines a clutch surface 25g. Clutch surface 25g co-operates with an annular friction washer 29 fabricated from industrial wet or dry clutch material, such as the material currently sold by Reddaway Manufacturing Company under the trademark "REDO MGP-1." A radial surface 30c on the cap actuator 30 supports the bottom surface of the friction washer 29 and it will be noted that the degree of compressive force on the friction washer 29 is determined by the spring 27.

The inner surface 30d of the cap actuator 30 is of tapered shape so as to fit snugly around the perimeter of a cap C (FIG. 4) when the capping head 10 is lowered by the shaft 8 into engagement with such cap. For this reason, the surface 30d is tapered with the smaller diameter thereof disposed at the upper end of the actuator 30 and, because the cap C is formed of a thermoplastic material, a number of peripherally spaced, axial extending grooves 30e are provided in the tapered surface 30d to insure that a firm grasping engagement of actuator 30 with the particular cap is obtained.

Additionally, the capping head 10 may include a cap positioning mechanism 40 which is employed to initially engage the top panel surface of a cap which is loosely positioned on the top of a bottle neck and exert an increasing force in a downward direction on the cap as the capping head 10 is lowered by shaft 8 to effect the engagement of the rotating cap actuator 30 with the side walls of the cap.

The cap positioning mechanism 40 includes a sleeve 41 having an out-turned radial flange 41a at its top end which is slidably mounted within an enlarged bore portion 25h of the secondary housing 25. Sleeve 41 is provided at its lower end with a transverse wall 41b and bolt 42 traverses a central aperture in the transverse wall 41b to secure the sleeve 41 to the end of a rod 43. The top end 43a of rod 43 is slidably mounted within the bore 12a of a stationary shaft 12 which is co-axially disposed relative to the hollow drive shaft 8 and is customarily provided on the capping machines of the type for which the capping heads of this invention are particularly applicable. A spring 13 is mounted in the bore 12a of the stationary shaft 12 and exerts a downward force on the top shoulder 43c provided on the rod 43. Thus the spring 13 maintains a constant bias on the end of the sleeve 41 tending to maintain the bottom end of such sleeve in an axially outwardly projecting position relative to the annular cap actuator 30 as shown in FIG. 3.

The actual engagement of the lower end of sleeve 41 with the cap C is accomplished by a plug assembly comprising a brass bushing 44 which is threaded into the lower end of sleeve 41 and a steel plug 45, having a radially enlarged head 45*a*, is mounted within the brass plug 44 for free rotation and secured therein by a split ring spring 46 which clamps into a suitable groove provided in the upper end of the shank portion 45*b* of the plug 45.

This arrangement permits the bottom face 45*c* of the plug 45 to engage the top panel portion of a cap C which is loosely positioned on a bottle neck and exert an increasing axially downward force on such cap as the entire capping head assembly 10 starts its downward movement relative to the bottle and cap positioned therebeneath. At the same time, the plug 45 is completely free of any rotational connection to the constantly rotating capping head 10 and hence does not impart any significant rotation to the cap which it engages. The downward movement of the capping head 10 first compresses the spring 13. Further downward movement of the capping head 10 produces compression of a second stiffer spring 47 disposed within the interior of the sleeve 41 and acting between the top face of the transverse wall 41*b* and a spring washer seat 48 mounted on the rod 43. During this movement, the sealing flange (not shown) of cap C is forced into the neck of bottle B. The length of vertical travel of the sleeve 41 and rod 43 is proportioned so that these elements are never positively prevented from upward relative movement with respect to the balance of the capping mechanism 10, (FIG. 4) as any blocking of this axial displacement would result in the imposition of an undesirable axial loading on the bottle and cap positioned under the respective capping head.

In the operation of the described mechanism, the bottom face 45*c* of the cap positioning mechanism 40 first engages the top panel of a cap C loosely positioned on a bottle B located directly beneath the particular capping head 10. As the capping head 10 is moved downwardly by the normal downward movement of the hollow shaft 8, the cap positioning mechanism 40 engages the top panel of the cap C and applies an increasing axially downward force on such cap to hold it in position until the annular cap actuator 30 is moved downwardly sufficient to engage the side walls of the particular cap and initiate the rotation of the cap. At this point further downward movement of actuator 30 effects the compression of spring 27, hence protecting an over height bottle B from breakage. Once the actuator 30 engages the cap side walls, the cap is rotated by such actuator to the position shown in FIG. 4, but only by a pre-determined degree of torque, inasmuch as the torque applied to the annular actuator 30 is strictly limited to the frictional force exerted between the clutch surfaces 25*g* and 30*c* between which the friction washer 29 is disposed. The torque transmitted from the rotating shaft 8 to the annular cap actuator 30 is strictly dependent on the amount of axial pressure exerted by the spring 27 and by the frictional characteristics of the friction washer 29.

It has been my observation that the frictional characteristics of the washer 29 vary substantially as a function of the humidity. It is well known that the humidity conditions within a bottling plant vary widely from start-up to normal operating conditions, and approaches one hundred percent after several hours of sustained operation. To maintain the humidity conditions surrounding the friction washer at a substantially uniform level, this invention contemplates the provision of an annular plastic sealing member 50 closely surrounding the chamber where the friction washer is disposed and thus effectively maintaining the humidity conditions around the friction washer at a reasonably constant value. The sealing member 50 may be formed of nylon or any other suitable thermoplastic or thermosetting material having sealing properties and comprises an annular member of generally inverted L-shaped cross-section. The horizontal leg 51 of the sealing member 50 rests on the top surface 25*f* of flange 25*c* of the secondary housing 25 beneath spring 27, and the other downwardly directed leg 52 snugly engages the outer cylindrical wall 30*f* of the annular cap actuator 30, thereby forming an essentially sealed chamber within which the friction washer 29 operates.

From the foregoing description, it will be apparent that this embodiment of the invention provides an inexpensive yet extremely reliable capping mechanism for applying plastic caps to the threaded neck of bottles with a uniform degree of maximum torque. The maximum torque to be employed in the application may be conveniently adjusted, and once adjusted, remains reasonably constant due to the enclosure of the friction material within a substantially sealed chamber, thus reducing the normal variations in humidity that the material would otherwise be subjected to.

Referring to FIGS. 5, 5*a*, 6 and 7, a capping head 100 embodying a modification of this invention is illustrated as comprising an annular primary housing 110 which is secured by cap screws 101 to the lower end of a hollow vertical applicating shaft 8 which is driven and axially moved by turret 1 in conventional fashion. The primary annular housing 110 comprises an upper cup-shaped element 111 which is rigidly secured to a depending sleeve-like element 112 by a plurality of bolts 109. The cup-shaped element 111 projects radially beyond the perimeter of the sleeve element 112 and the bottom surface 113 of such radially projecting portion cooperates with the top radial face of an annular friction element 114.

The lower portions 115 of the sleeve element 112 provide a mounting for anti-friction bearing units 116 and an annular secondary housing 120 is supported by the bearings 116 for rotation relative to the primary housing 110. A split ring spring 117 mounted in a suitable groove on sleeve element 112 engages the bottom face of bearing unit 116 and a split ring spring 118 in secondary housing 120 engages the top-face of bearing unit 116.

Secondary housing 120 is of generally sleeve-like configuration and its top end is rigidly secured, as by radially disposed pins 121 to an annular clutch face unit 125. The clutch face unit 125 is yoke-shaped in cross-sectional configuration with the stem portion 126 snugly surrounding the upper portions of the secondary housing 120 and the yoke arm portions 127 defining an upwardly facing annular recess having a radial bottom surface 128 which co-operates with the adjacent surface of the annular friction washer 114.

A spring 130 is provided which engages the outer shoulder of the yoke-shaped portion 127 of the clutch member. The other end of spring 130 rests upon a support ring 131 which is adjustably secured to the outer perimeter of secondary housing 120 by threads 133. Thus, the effective frictional force exerted on the friction ring 114 may be adjusted and this determines the maximum torque that can be transmitted from the primary housing 110 to the secondary housing 120.

In the bottom portions of secondary housing 120 an annular cap applicator 140 is rigidly secured as by a plurality of radially disposed set screws 141 which pass through the walls of secondary housing 120 to engage appropriate apertures 142 provided in the walls of the annular cap actuator 140. The inner wall 143 of the annular cap actuator 140 is of generally tapered configuration so as to conveniently engage the side walls of a cap C which is positioned below the capping head 100 in loosely pivoting relationship on the top of a bottle neck. Tapered surface 143 is additionally provided with a plurality of circumferentially spaced, axial extending grooves 144 which effect a grasping action on the flexible side walls of the thermoplastic cap and thus effect the rotation of the cap onto the bottle neck. The secondary housing 120 and the cap actuator 140 are hereinafter referred to as a cap actuating assembly.

A cap positioning mechanism 150 is provided which is mounted within the bores of the primary housing 110 and the secondary housing 120. Such mechanism comprises a cup-shaped sleeve 151 having an enlarged flange portion 152 which is axially slidable within the bore 112*a* of the sleeve portion 112 of the primary housing 110. A compression spring 153 is provided which has its bottom end seated in the bottom of the cup-shaped sleeve 151 and its top end abutting a washer 154 which engages the end face 12*b* of a stationary depending shaft 12 which is normally provided in the cap applicating turret 10 in coaxial relation with rotating hollow shaft 8'. Additionally a spring pressed plunger 155 is slidably mounted for axial movements by an aperture 154 provided in the base portion of the cup-shaped sleeve 151 and by the bore of the spring seat washer 153. The bottom end of plunger 155 normally projects beyond the end face of the sleeve 151 and this is the first element to contact the loosely positioned cap on the bottle as the capping head 100 is moved downwardly by the power shaft 8'. A relatively light downward spring bias is imposed on plunger 155 by a spring 156 which engages a shoulder 157 on the plunger at its lower end and at its top end engages the base of the axial bore 12*a* provided in the stationary shaft 12. In this modification, any spring cushioning of the cap actuator 140 after contact with a cap C must be provided in the mounting of shaft 8' to the machine A.

It will be noted that a depending axial flange 119 is provided on the enlarged portion 111 of the primary housing 110 which flange snugly engages the outer wall of the yoke-shaped portion 127 of the clutch face unit 125. Similarly, the inner wall of the yoke-shaped clutch unit 125 snugly engages the outer wall of the sleeve element 112. These close fits insure that the friction ring 114 is essentially operating in a sealed chamber and fully protected from ambient humidity. To insure that ambient humidity variations will have no effect on the effective friction exerted by the ring 114, the recess provided in the yoke-shaped portion 127 may be partially filled with a lubricating oil, thereby maintaining the effective surface of friction ring 114 in a constantly saturated condition and hence more immune to any variations in ambient humidity.

Figure 5A:
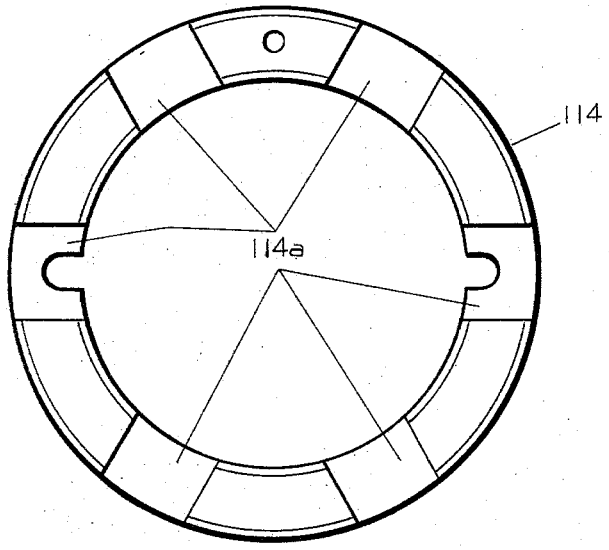
FIG. 5*a* is a bottom plan view of the friction washer employed in the modification of FIG. 5.
Figure 6:
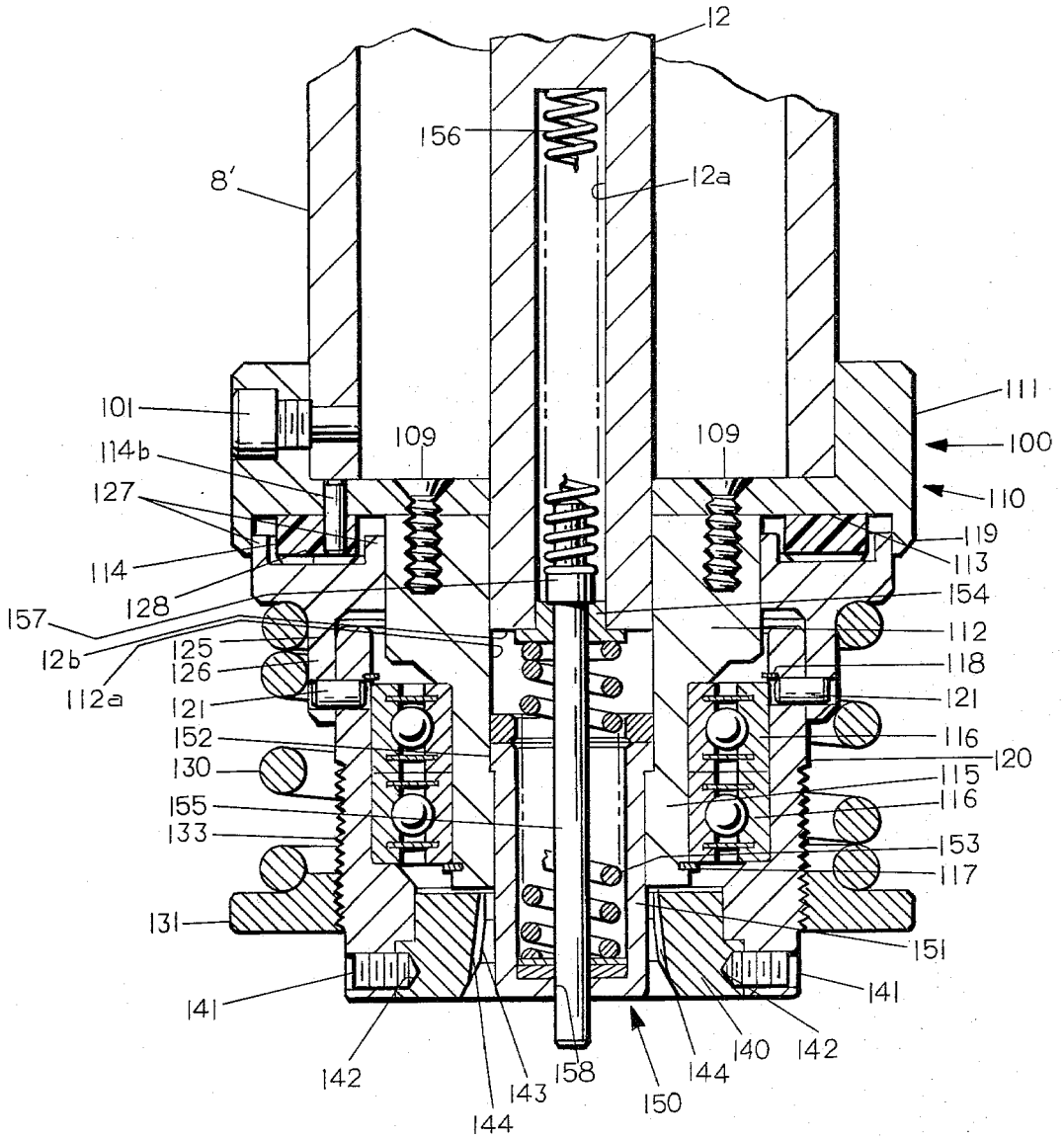
FIG. 6 is a sectional view taken along the plane of 6—6 of FIG. 5 illustrating the position of the elements of the capping head prior to engagement with a cap to be applied to a bottle.
Figure 7:
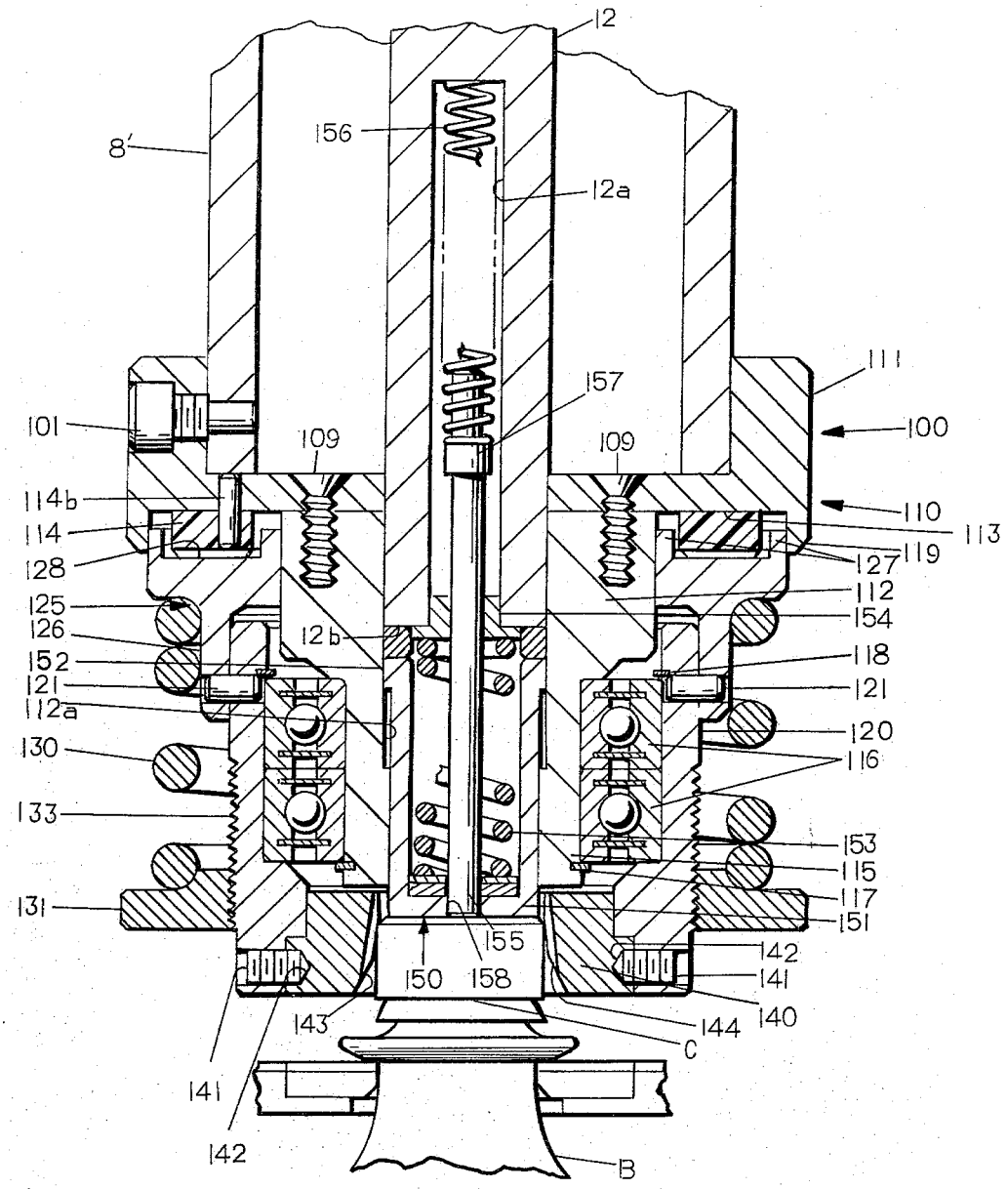
FIG. 7 is a view similar to FIG. 6 but showing the position of the elements of the capping head after full engagement of the cap with the screw threaded neck of the bottle has been achieved.

As shown in FIG. 5*a*, friction washer 114 is provided with transverse recesses 114*a* in its bottom face, thus assuring the flow of oil over all the effective clutch surface. A pin 114*b* secures the washer 114 to housing 110 for co-rotation, thus making the bottom face of washer 114 the clutching surface.

As mentioned above, this construction eliminates one of the most common problems encountered in operating cap applicating machines having friction clutches for limiting the effective applied torque. Humidity conditions in a typical bottling plant vary widely, particularly when starting-up after an overnight or weekend shutdown in the wintertime. The humidity variation could in the matter of four to six hours change from thirty percent to essentially a hundred percent and in all prior art constructions, this variation in humidity would drastically effect the frictional characteristics of the slip clutch employed to limit the torque transmitted to the closure by the applicating head.

Figure 8:
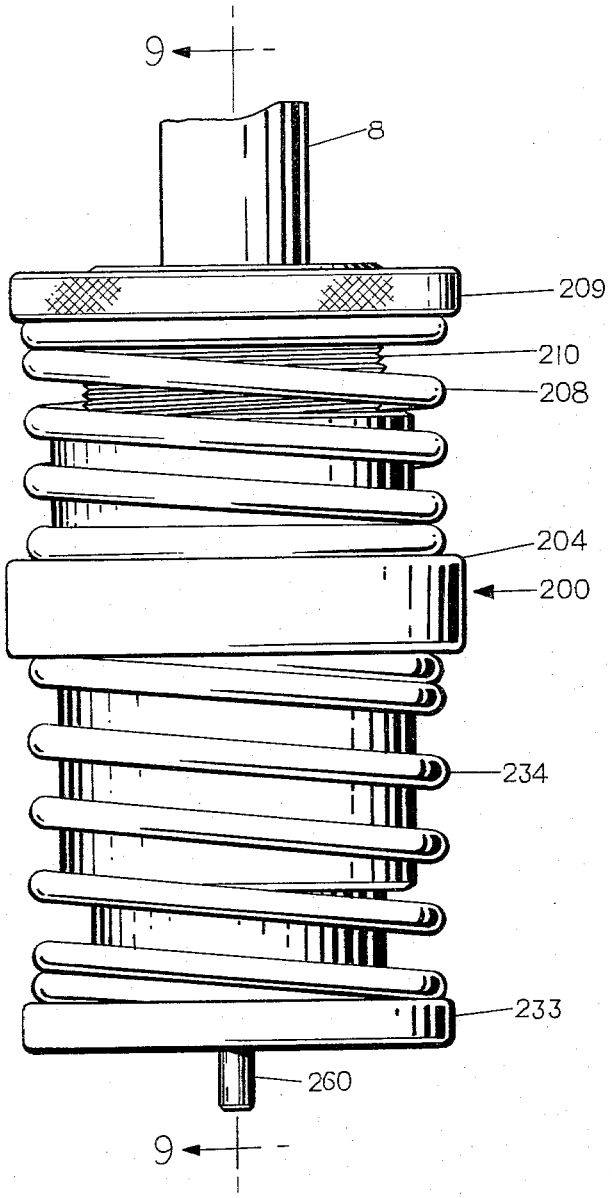
FIG. 8 is a side elevational view of a modification of a capping head embodying a still further modification of this invention.
Figure 9:
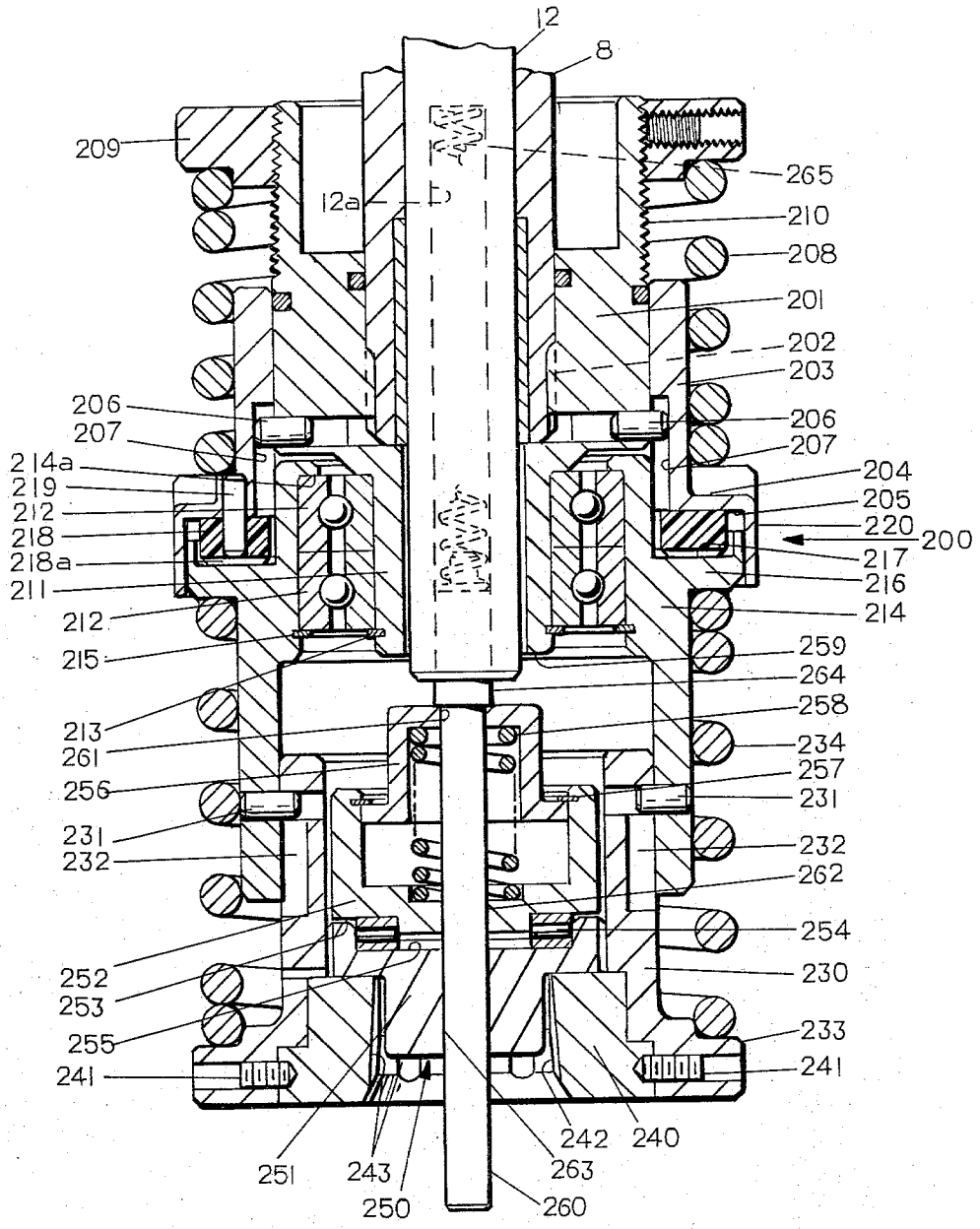
FIG. 9 is a sectional view taken along the plane 9—9 of FIG. 8 showing the position of the elements of the capping head prior to engagement with a cap to be applied to a bottle.
Figure 10:
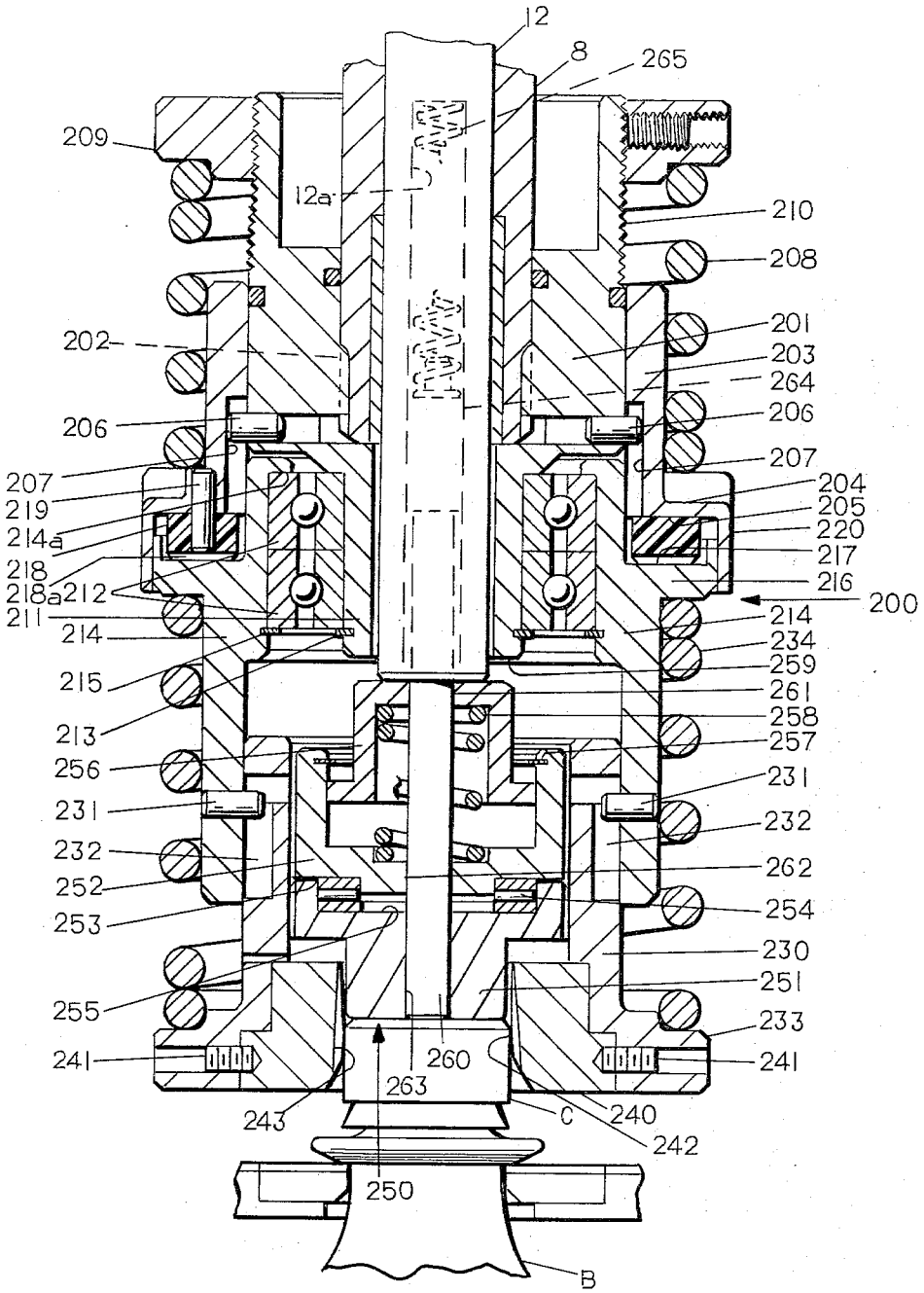
FIG. 10 is a view similar to FIG. 9 but showing the position of the elements of the capping head after a full threaded engagement of the cap with a screw threaded neck of the bottle has been achieved.

Referring now to FIGS. 8, 9 and 10, there is shown a capping head 200 embodying a further modification of this invention.

Capping head 200 includes an annular primary housing 201 which has its central portion provided with internal threads 202 which engage the threaded bottom end of the rotating drive shaft 8 conventionally provided on the cap applicating machine A.

A sleeve 203 is slidably mounted on the upper portion of the primary housing 201 and sleeve 203 has a radially outward flange 204 which has a downwardly facing radial surface 205 forming one surface of a friction clutch. Sleeve 203 is secured to primary housing 201 for co-rotation by a plurality of radially disposed pins 206 respectively co-operating with axially extending slots 207 provided on the interior wall of the sleeve 203. A spring 208 is provided which bears against the upper surface of the radial flange 204 and at its top end is compressed by an internally threaded collar 209 which is adjustably mounted on the primary housing 201 on threads 210.

The lower portion of primary housing 201 defines a bearing mounting sleeve 211 and a pair of anti-friction bearing units 212 are suitably secured to such sleeve, as by a split ring spring 213.

Bearing units 212 journal the top end of a secondary housing 214 for rotation relative to the primary housing 201. Bearings 212 are retained within the secondary housing 214 by abutting against an internal shoulder 214*a* provided at the top end of the housing and being retained in that position by a split ring spring 215 mounted in an appropriate groove in secondary housing 214 at a point adjacent the lower end of the bearing units 212.

Adjacent to the top portions of the secondary housing 214, the housing is provided with an outwardly projecting flange 216, the top surface of which is recessed to form an annular channel having a radial bottom surface 217 which forms the other clutching surface of the friction clutch. A friction washer 218 of the same wet-dry clutch material heretofore mentioned is mounted between the clutching surfaces 217 and 205 and is secured for co-rotation to the surface 205 by a vertical pin 219.

The lower portions of the radial extension 204 is provided with a depending annular flange 220 which snugly surround the exterior walls of the projection 216 on the secondary housing 214 thus defining a sealed chamber within which the friction washer 218 is disposed. The chamber is partially filled with a lubricating oil. Friction washer 218 is provided with transverse slots 218*a* in its bottom surface and these slots assure that the oil is always in contact with the active surfaces of the bottom face of the friction washer 218. Thus the effects of ambient humidity variations on the friction characteristics of the friction washer 218 are essentially eliminated.

The lower portions of secondary housing 214 are of sleeve-like configuration and provide an axially shiftable mounting for an annular cap actuator mounting sleeve 230. Sleeve 230 is secured for co-rotation with the secondary housing 214 by virtue of a plurality of radial pins 231 traversing the walls of secondary housingg 214 and respectively engaging axially extending slots 232 provided in the side walls of the actuator support sleeve 230.

The bottom end of actuator support sleeve 230 is provided with a radial flange 233 and the top surface of such flange provides a seat for a spring 234. The other end of spring 234 abutts against the lower surface of the clutch flange 216.

The internal bore of the actuator support sleeve 230 supports an annular cap actuator 240. A plurality of radially disposed screws 241 traversing the side walls of support sleeve 230 secure the annular cap actuator 240 to the support sleeve 230 for co-movement. The secondary housing 214, the support sleeve 230 and the actuator 240 are hereinafter referred to as a cap actuator assembly.

The internal bore surface 242 of the annular cap actuator 240 is tapered to decrease in diameter in an upward direction and is additionally provided with a plurality of axially extending grooves 243 to securely engage the side walls of a plastic cap C with which the actuator is brought into engagement by downward movement of the rotating shaft 8 of the capping machine A at an appropriate point in the passage of the capping head 200 around the periphery of such machine.

As in the previously described modifications, a cap positioning mechanism 250 is provided comprising an annular cap head engaging element 251 which is mounted for relatively upward axial movement within the bore of the secondary housing 230. Immediately above the element 251 there is provided a cup-shaped lower spring seat 252 having a bottom annular radial shoulder 253. A thrust bearing assembly 254 is mounted between the radial shoulder 253 and the top face 255 of the cap engaging element 251. An inverted cup-shaped spring retainer 256 is mounted in the top portions of the lower cup-shaped spring seat 252 and retained therein by a split ring spring 257. A compression spring 258 then operates between the base portions of the two cup-shaped elements 252 and 256 respectively.

A cap positioning plunger 260 is provided which is journalled for relative axial movements by aligned bores 261 in upper spring retainer 256, bore 262 in lower spring seat 252 and bore 263 in the cap engaging element 251. The lower end of the plunger 260 normally projects substantially below the cap actuator 240 and hence is the first element to engage the loosely positioned cap C on the bottle neck. An enlarged shoulder 264 is provided on the upper portion of the plunger 260 and limits the downward movement of the plunger by engaging the top surface of the upper spring seat 256. The top end of the shoulder 264 forms a base for a compression spring 265 which is mounted within the bore 12*a* of the stationary shaft 12 conventionally provided on applicating machine A in co-axial relationship with the rotating hollow shaft 8.

From the foregoing description, it is apparent that as the capping head 200 is lowered by the hollow shaft 8 toward a cap C loosely positioned on a bottle B, the plunger 260 engages the top surface of such cap C to stabilize it. The plunger 260 moves upwardly relative to the cap actuator 240 and the cap head engaging element 251 against the relatively light bias of spring 265. This permits the cap head engaging element 251 to also move upwardly until the top surface of the upper spring seat 256 engages the lower end face 259 of the primary housing 201. From that point on, further downward movement of the capping head 200 effects a compression of the relatively stiff spring 258 and this intensified downward force applied to the cap C forces a seating of the conventional internal sealing flange (not shown) provided on such cap with the interior of the bottle neck. It will be noted that both the plunger 260 and cap engaging element 251 are not rotationally connected to the other elements of the applicating head 200 and hence do not impart any rotation to the engaged cap.

As the capping head 200 completes its downward movement, (FIG. 10) the annular cap actuator 240 engages the side walls of the cap C and rotates the cap into engagement with the threads of the bottle neck until a pre-determined degree of torque is applied as determined by the amount of compression exerted by spring 208 on the friction washer 218. The amount of torque to be exerted may be conveniently adjusted by rotating the spring seat collar 209 relative to the primary housing 201. The maximum torque is not effected by the wide variations in ambient humidity conditions normally encountered in a bottling plant because of the enclosure of the friction washer 218 within an essentially sealed chamber and the provision of oil in the base of the chamber to continuously lubricate the effective clutching surfaces of the friction washer 218.

It will also be noted that in this modification, the spring 234 opposes the axially upward movement of the annular cap actuator 240 produced by the final lowering movement of the capping head 200 to the position shown in FIG. 10. The spring force on the friction washer 218 is not affected.

Modifications of this invention will be readily apparent to those skilled in the art and it is intended that the scope of the invention be determined solely by the appended claims.

I claim:

1. In a capping machine of the type having a rotating turret arranged to successively move the plurality of bottles around its perimeter and including means for loosely positioning a threaded cap on the threaded neck of each bottle, a continuously rotating cap applicator shaft located above each bottle and movable therewith around the turret, and means for moving each applicator shaft downwardly towards the respective bottle for a portion of the peripheral path of the bottle around the turret, the improvement comprising a capping head carried by each applicator shaft including the following elements:

(1) an annular housing assembly adapted to be rigidly secured to the lower end portions of the cap applicator shaft;

(2) an annular cap actuator assembly mounted for rotation relative to said annular housing assembly, said annular cap actuator assembly having means on its inner wall for engaging a cap positioned on a bottle in the turret to rotate the cap;

(3) a pair of annular radial surfaces respectively provided on said housing and said cap actuator assembly and disposed in axially spaced alignment;

(4) a washer of frictional material mounted between said radial surfaces;

(5) resilient means urging said radial surfaces towards each other, thereby controlling the amount of friction exerted on said friction washer, and (6) means for shielding said friction washer from ambient air, thereby maintaining the friction characteristics of said washer substantially independent of ambient humidity conditions.

2. The improvements of claim 1 where in said last mentioned means comprises an annular plastic shield surrounding the exposed portions of said friction washer.

3. The improvements of claim 1 wherein last mentioned means comprises co-operating cylindrical surfaces on said housing assembly and said cap actuator assembly defining a chamber within which said friction member is mounted, said chamber being at least partially filled with oil.

4. The improvement defined in claim 1 wherein one of said annular radial surfaces is defined by a radially projecting shoulder on a sleeve that is co-rotatable but axially slidable relative to said annular housing, and said resilient means comprises a compression spring having one end seated on said radially projecting shoulder and the other end abutting a ring threadably secured to said annular housing.

5. The improvement defined in claim 4 wherein the other of said annular radial surfaces is defined by a radially projecting shoulder on said cap actuator assembly, and said assembly includes an annular cap engaging member co-rotatable with but axially shiftable relative to the cap actuator assembly, a radial shoulder on said annular cap engaging member, and a compression spring mounted between the aforementioned radial shoulders.

* * * * *